US009776309B2

(12) United States Patent
Fluhrer

(10) Patent No.: US 9,776,309 B2
(45) Date of Patent: Oct. 3, 2017

(54) PORTABLE BATTERY-OPERATED TOOL WITH AN ELECTRICAL BUFFER ELEMENT AND METHOD FOR REPLACING THE RECHARGEABLE BATTERY

(75) Inventor: Andreas Fluhrer, Murrhardt (DE)

(73) Assignee: Robert Bosch GmbH, Stuttgart (DE)

( * ) Notice: Subject to any disclaimer, the term of this patent is extended or adjusted under 35 U.S.C. 154(b) by 1271 days.

(21) Appl. No.: 13/334,653

(22) Filed: Dec. 22, 2011

(65) Prior Publication Data

US 2012/0167721 A1 Jul. 5, 2012

(30) Foreign Application Priority Data

Dec. 29, 2010 (DE) ..... 10 2010 056 523

(51) Int. Cl.

| | |
|---|---|
| ***B25B 21/00*** | (2006.01) |
| ***B25B 23/00*** | (2006.01) |
| ***B25F 5/00*** | (2006.01) |
| ***B25B 23/14*** | (2006.01) |

(52) U.S. Cl.

CPC ..... *B25B 21/00* (2013.01); *B25B 23/14* (2013.01); *B25F 5/00* (2013.01)

(58) Field of Classification Search

CPC ..... H02K 7/145; H02K 5/148; H01H 9/063; Y02E 60/12; Y02E 60/13; H02J 7/0042; H02J 7/0045; H02J 7/0044; H02J 7/345; H02J 7/0016; H01M 10/46; H01M 21/1055; H01G 9/155; B25B 21/00; B25B 23/14; B25F 5/00

USPC ..... 173/1, 2, 11, 52, 157; 192/34; 320/166, 320/128, 167, 107, 112–115; 310/47, 50; 81/479

See application file for complete search history.

(56) References Cited

U.S. PATENT DOCUMENTS 5,347,163 A * 9/1994 Yoshimura ..... G11O 5/141 307/150
5,426,690 A * 6/1995 Hikuma ..... H04M 1/72516 455/411
5,515,303 A * 5/1996 Cargin, Jr. ..... B60R 11/02 235/375
5,519,871 A * 5/1996 Shimoda ..... G06F 1/30 713/300
5,522,034 A * 5/1996 Watari ..... G01R 31/007 307/10.7
5,898,290 A * 4/1999 Beard ..... G06F 12/1408 307/116
5,903,462 A * 5/1999 Wagner ..... G05D 17/02 318/490

(Continued)

*Primary Examiner* — Hadi Shakeri
(74) *Attorney, Agent, or Firm* — Maginot, Moore & Beck LLP

(57) ABSTRACT

A portable and battery-operated tool for machining a workpiece and to a method for replacing the rechargeable battery of the tool is disclosed. The tool has at least one drive device for driving a working head, at least one rechargeable battery for providing electrical energy, at least one control device with an operating system for controlling and/or regulating machining parameters, at least one storage device for storing machining data and at least one transmitting and receiving device for transmitting and/or receiving the machining data and also at least one substantially electrical element for storing electrical energy at least for a short time in order to make it possible to replace the rechargeable battery when the operating system is activated.

3 Claims, 2 Drawing Sheets

(56) References Cited

U.S. PATENT DOCUMENTS

| | | | | |
|---|---|---|---|---|
| 6,390,205 | B2 * | 5/2002 | Wallgren | B25B 21/00 173/171 |
| 6,405,598 | B1 * | 6/2002 | Bareggi | B25B 23/14 73/761 |
| 6,536,536 | B1 * | 3/2003 | Gass | B23B 31/123 173/171 |
| 6,631,101 | B1 * | 10/2003 | Chan | G11B 19/04 369/30.24 |
| 7,954,557 | B2 * | 6/2011 | Cutler | B25B 21/00 173/1 |
| 8,234,936 | B2 * | 8/2012 | Nakata | B25B 23/1425 73/862.21 |
| 8,340,861 | B2 * | 12/2012 | Lipscomb | G07C 5/0808 701/29.1 |
| 2004/0158357 | A1 * | 8/2004 | Lee | B60L 11/1833 700/258 |
| 2009/0303061 | A1 * | 12/2009 | Greenlee | G06K 19/07309 340/636.15 |
| 2011/0063649 | A1 * | 3/2011 | Komatsu | G06F 1/263 358/1.14 |
| 2011/0208456 | A1 * | 8/2011 | Mickelsen | G06F 1/30 702/64 |
| 2014/0180531 | A1 * | 6/2014 | Lipscomb | G07C 5/008 701/33.2 |

* cited by examiner

PORTABLE BATTERY-OPERATED TOOL WITH AN ELECTRICAL BUFFER ELEMENT AND METHOD FOR REPLACING THE RECHARGEABLE BATTERY

This application claims priority under 35 U.S.C. §119 to patent application no. DE 10 2010 056 523.7, filed Dec. 29, 2010 in Germany, the disclosure of which is incorporated by reference herein in its entirety.

BACKGROUND

The present disclosure relates to a portable tool for machining a workpiece and to a method for replacing a rechargeable battery of a portable tool.

Conventionally used battery-operated tools usually have a rechargeable battery or battery which supplies an electric motor with electrical energy so that said electric motor can move or drive the parts accordingly used to carry out work.

In the case of tools which have a simple design and do not have a control device for controlling and regulating different consumption units, for example, a measuring and/or analysis device for determining the performance or work carried out or achieved by the tool, replacing the rechargeable battery or battery is unproblematic since use of the tool can be immediately continued after the new or charged rechargeable battery has been inserted.

The situation is different, however, with battery-operated tools having a control device which, for example, in the case of a cordless screwdriver, regulates and controls the torque or the rotational speed of the screwing head and monitors it by means of corresponding measuring devices. In the case of these tools, the control device is deactivated or switched off when removing the rechargeable battery, which, for example, has been discharged from the tool, as a result of which the operating system in the control device or the specific software is likewise shut down. After the new or charged rechargeable battery has been inserted into the tool, the control device must consequently be activated or switched on again, as a result of which the operating system is rebooted or started up again or restarted.

Since the operation of starting up the operating system takes some time, a workpiece cannot be machined using the tool within this period of time. As a result, the cycle times for machining a workpiece are considerably extended, particularly in tools in which it is necessary to frequently change the rechargeable battery.

Therefore, the object of the present disclosure is to provide a portable and battery-operated tool for machining a workpiece and a corresponding method, wherein the tool and method make it possible to replace a rechargeable battery when the operating system or software is activated.

SUMMARY

Consequently, the disclosure claims a portable tool for machining a workpiece, in particular for fitting screws to the workpiece, the tool having at least one drive device for driving a working head or at least one element of a drive head, for example a drive shaft, at least one rechargeable battery for providing electrical energy, at least one control device with an operating system for controlling and/or regulating machining parameters, at least one storage device for storing machining data and at least one transmitting and receiving device for transmitting and/or receiving the machining data.

The tool according to the disclosure also has at least one substantially electrical element for storing electrical energy at least for a short time in order to make it possible to replace the rechargeable battery when the operating system is activated. Therefore, the portable or mobile tool preferably has an electric motor which is supplied with electrical energy by a rechargeable battery or battery, with the result that no electric cable has an adverse effect on the mobility of the tool. As a result, the tool according to the disclosure can be moved without restriction in order to preferably reach all machining areas of a workpiece in order to be able to accordingly machine the latter. On account of the absence of the electric cable, the risk of the workpiece or its surfaces being damaged by the cable or any couplings of the cable is also excluded. Furthermore, the safety of the worker or user who could easily injure himself on defective electric cables or could easily trip over cables lying around is increased at the same time. The electric motor itself is preferably used to drive a working head or part of the latter, for example a grinding wheel or a screwdriver.

The rechargeable battery can also, for example, additionally provide electrical energy for a control device which is used, inter alia, to control and/or regulate machining parameters, for example the number of machining steps to be carried out or the rotational speed and/or the torque of a screwdriver. Therefore, the control device advantageously monitors each machining step carried out by the tool and consequently compares the desired machining values with the actual machining values in order to possibly detect incorrect machining and preferably indicate this to the user.

The machining data which indicate to the tool how the latter should machine a particular workpiece are advantageously transmitted to the tool by a central control device. Consequently, the tool has a transmitting and receiving device which receives these desired machining data, for example. In this case, the transmitting and receiving device is a device assigned to the control device or an independently operating device.

The desired machining data, that is to say the machining data transmitted or sent from the central control device to the tool and preferably to the transmitting and receiving device of the tool, comprise, for example, the machining parameters required for machining, for example a desired rotational speed and/or a desired torque. Consequently, it is conceivable to use, for example, a scanning device which is arranged on the tool or is connected to the tool for the purpose of transmitting data to scan or detect, for example, a bar code on the tool in order to thereby recognize the workpiece to be machined. The data determined from the bar code are then forwarded to the central control device via the transmitting and receiving device in order to thereby retrieve the necessary machining data.

The central control device uses, for example, the data transmitted from the transmitting and receiving device of the tool to determine the article number of the workpiece and preferably the corresponding machining order or the order number and thus the machining parameters required for machining, for example the necessary torque when screwing in a screw.

The machining data selected by the central control device are then transmitted back to the tool and preferably to the transmitting and receiving device of the tool again. The control device of the tool thus receives all machining data needed to machine the present workpiece, which has been scanned in, and consequently preferably sets the corresponding values for the machining by the tool depending on the machining step.

A camera or an image capture device can be used, for example, to detect the current machining position on the workpiece, with the result that the control device makes it possible to detect the current machining position on the workpiece by comparing the image with the image files stored in the storage device. As a result, it is possible for the control device to set the machining parameters for the working head depending on the detected machining position.

Recognition of the workpiece is also conceivable using this image capture device which would thus replace a barcode scanner, with the result that only a device which, in addition to recognizing the workpiece in order to retrieve the machining data, also detects the individual machining positions of the tool could be used on the tool.

It is also conceivable for the machining data needed to machine the workpieces, that is to say desired machining data, to already be stored on the storage device of the tool, with the result that it is only necessary to detect the workpieces in order to determine the data needed for machining or to read said data from the storage unit. In this case, a connection to the central control device is no longer absolutely necessary, with the result that, even in the event of a disruption in the connection which preferably takes place via radio, the operator can continue the machining of the workpiece using the tool without any problems.

During the machining of the workpiece, the tool preferably monitors or records the machining process in a substantially continuous manner and consequently determines the current actual machining data. That is to say, the current torque or the current rotational speed is determined, for example in the case of a cordless screwdriver, and is compared with the desired machining parameters for this defined machining position. If the actual machining parameters do not match the desired machining parameters, it is possible for the tool to warn the worker or operator using an acoustic or visual signal, for example. Consequently, the tool preferably has corresponding illumination and/or loudspeaker devices.

The machining data or machining parameters determined by the tool, that is to say the actual machining parameters, are preferably stored, at least for a short time, in the storage device of the tool in such a manner that an actual machining parameter is assigned to each desired machining parameter, for example. All recorded actual machining parameters are preferably assigned to the recorded article number and possibly a corresponding order number or a workpiece number, with the result that it is possible to read the actual machining parameters which have occurred for the corresponding workpiece data.

In one preferred embodiment, the actual machining data record or the actual machining data is/are then transmitted from the tool, and preferably from the transmitting and receiving device of the tool, to the central control device in order to be loaded there into a corresponding analysis program, for example. As a result, the worker or operator is able to carry out a quality analysis or to trace back the machining quality of individual machined workpieces at any time, for example.

Determining the machining data or the machining parameters for machining and monitoring these actual machining parameters by comparing them with the desired machining parameters or machining data prevents a workpiece being incorrectly machined by a worker even when the machining process is very highly complex, that is to say in the case of a multiplicity of machining steps taking place one after another and in the case of a multiplicity of different workpieces.

In addition to the drive device, that is to say the electric motor for driving a working head, and the scanning device and/or the image capture device and the control device and/or the storage device and/or the transmitting and receiving device, which is likewise a device subordinate to the control device or a device independent of the control device, the rechargeable battery can also supply, for example, at least one measuring device and/or at least one detection device with electrical energy.

The measuring device is, for example, a device for measuring actual machining parameters, for example a torque or a rotational speed of a screwdriver, for example. In contrast, the detection device determines, for example, a screwing-in angle between the screw to be screwed in and the workpiece in order to prevent the screw from being obliquely screwed in and thus being wedged in the thread. In this case, just like the scanning device and the image processing device or the illumination device or the loudspeaker device etc., the measuring device and the detection device are preferably consumption units of the tool which are all supplied using the electrical energy from the rechargeable battery.

If it is then necessary to replace the rechargeable battery of the tool, the control device on which the operating system runs should preferably nevertheless still be supplied with electrical energy in order to prevent the operating system from being shut down. For this purpose, the tool according to the disclosure preferably has an electrical element which can store electrical energy at least over a short period of time. In one preferred embodiment, this electrical element is a capacitor, particularly preferably an electrolytic capacitor. However, it is also conceivable for the electrical element to be a further rechargeable battery or battery which can provide the control device, for example, with electrical current or electrical energy even while replacing the rechargeable battery or the main rechargeable battery. However, a capacitor is advantageously arranged as the electrical element in the tool, which is preferably a battery-operated handheld screwdriver, since, although a capacitor can provide electrical energy only over a very short period of time in comparison with a rechargeable battery or battery, it can be charged and discharged substantially without restriction. The capacitor therefore has a very long service life.

The capacitor is preferably continuously charged during operation of the tool. However, it is also conceivable for the capacitor to be charged only on request by the control device. Such a request is emitted by the control device, for example, when the rechargeable battery signals to the control device that it is almost discharged. Furthermore, it is possible for the request to charge the capacitor to be made only when, for example, a detection device, which is a device subordinate to the control device or a device independent of the control device, detects removal of the rechargeable battery by virtue of an unlocking mechanism, for example a switch, being activated or deactivated, for example, thus charging the capacitor.

The removal of the rechargeable battery can be detected, for example, by a protective cover of the housing being opened. If a connection (electrical or mechanical) between the protective cover of the tool and the tool is interrupted, the detection device detects the opening of the protective cover and thus the intention to remove the rechargeable battery. It is also conceivable for the worker to push a corresponding lever or a corresponding button, for example, in order to signal the removal of the rechargeable battery to the control device and preferably to the detection device, as a result of which corresponding subsequent steps, for example charging of the capacitor, are initiated.

The control device is preferably connected to the consumption units for data purposes in order to deactivate consumption units of the tool when the rechargeable battery is removed from the tool. That is to say, the control device is connected to the consumption units, for example the measuring device, the scanning device or else the transmitting and receiving device and the storage device, if they are not devices which are subordinate to the control device, by means of a data cable in order to deactivate them when removal of the rechargeable battery is detected. It is also possible for the control device to also be connected to corresponding switching devices which can disconnect the consumption units from the rechargeable battery and preferably from the electrical element, that is to say the capacitor, if necessary. The control device thus activates these switching devices when replacement of the rechargeable battery is detected, as a result of which the consumption units are disconnected from the supply of electrical energy, that is to say from the rechargeable battery and the capacitor, by virtue of the switching units opening, for example, in order to prevent a flow of current to the consumption units.

Only the control device is preferably connected to the electrical element in order to be supplied with electrical energy even while the rechargeable battery is being replaced. That is to say, for example, the electrical connection between the electrical element and the control device is preferably not interrupted during the operation of replacing the rechargeable battery. Therefore, there is preferably no need to shut down the operating system even while the rechargeable battery is being replaced since the control device need not be completely switched off or deactivated. Consequently, the operating system need not be started up or booted again after a new or charged rechargeable battery has been inserted, as a result of which no valuable time for machining a workpiece is lost, but rather the machining process can be continued immediately.

Consequently, the disclosure also claims a method for replacing a rechargeable battery of a portable tool for machining workpieces, the tool having at least one drive device for driving a working head, at least one rechargeable battery for providing electrical energy, at least one control device with an operating system for controlling and/or regulating machining parameters, at least one storage device for storing machining data and at least one transmitting and receiving device for transmitting and receiving the machining data, having the following steps:

a) removal of the rechargeable battery from the tool is detected using the control device of the tool;

b) transmission of the machining data from a central control device to the transmitting and receiving device of the tool is interrupted using the control device;

c) the control device is changed to a standby operating state, and d) the control device is supplied with electrical energy from the electrical element while the rechargeable battery is being replaced.

Consequently, when a rechargeable battery is removed from a tool, which is preferably a battery-operated handheld screwdriver which can be used in a mobile manner, the removal of the rechargeable battery is preferably detected using a detection device. For example, a light barrier may also be arranged on the rechargeable battery or on a protective cover, which isolates the rechargeable battery from the outside world, in such a manner that the light barrier is interrupted when the protective cover is opened or when the rechargeable battery is removed, as a result of which a signal indicating the removal of the rechargeable battery is transmitted to the control device of the tool. After the removal of the rechargeable battery has been detected, the transmission of desired and/or actual machining data from a central control device to the tool and preferably to the transmitting and receiving device of the tool or from the tool and preferably from the transmitting and receiving device of the tool to the central control device is advantageously interrupted in order to avoid a loss of data and to prevent the energy-intensive transmission and reception of data, thus reducing the electrical energy required while changing the rechargeable battery.

Therefore, the transmission and consequently the preferably wireless radio link are changed to a power-saving sleep mode in which, although the connection between the central control device and the tool or the transmitting and receiving device of the tool is retained, no data whatsoever can be interchanged. This avoids time-consuming reconnection or time-consuming re-establishment of the radio link between the central control device and the tool or the transmitting and receiving device of the tool after a new or charged rechargeable battery has been inserted. In addition, the control device of the tool itself is changed to a standby operating state, that is to say to a standby mode, as a result of which the operating system of the control device does not need to be shut down and consequently does not need to be rebooted or started up again either after the control device has been activated. As a result, the tool can be used further directly without delay after the rechargeable battery has been changed.

The control device is thus preferably the only device or unit of the tool which is provided with electrical energy while the rechargeable battery is being replaced in order to avoid the operating system being shut down. For this purpose, while the rechargeable battery is being replaced, the control device preferably obtains electrical energy from the capacitor or an ancillary rechargeable battery or battery. In one preferred embodiment, at least one consumption unit of the tool, which is connected to the rechargeable battery, is deactivated using the control device when removing the rechargeable battery from the tool. In another preferred embodiment, all consumption units are deactivated using the control device when removing the rechargeable battery from the tool, with the result that only the control device itself, which is in a power-saving or energy-saving standby mode, however, preferably needs to be supplied with electrical energy. That is to say, for example, any measuring devices or detection devices or else the storage device and/or the transmitting and receiving device, if they are not devices which are assigned or subordinate to the control device, are switched off or deactivated, with the result that these consumption units no longer require any electrical energy needed to perform their activities while the rechargeable battery is being replaced.

If, for example, the storage device and/or the transmitting and receiving device is/are (a) device(s) assigned or subordinate to the control device, it/they is/are preferably changed, with the control device, to a power-saving sleep mode, as a result of which, for example, the storage device can no longer store machining data and the transmitting and receiving device can no longer transmit and/or receive machining data. Only the radio link between the transmitting and receiving device and the central control device is maintained but without interchanging or transmitting data.

The machining data transmitted from the central storage device to the tool before the rechargeable battery is replaced are preferably stored in the storage device of the tool when the removal of the rechargeable battery from the tool is detected. Therefore, for example, all machining data which contain, for example, information about or relating to the workpiece to be machined and are transmitted from the central control device to the tool and preferably to the transmitting and receiving device of the tool in order to machine the workpiece are only then stored in the storage device, that is to say in a non-volatile memory of the tool, as soon as, for example, a detection device or else the control device of the tool detects the removal of the rechargeable battery. That is to say, the machining data transmitted from the central control device to the tool during operation or use of the tool, that is to say the desired machining data, are preferably buffered in a volatile memory, such as a main memory, in order to provide the control device of the tool with the necessary information relating to the machining or the individual machining steps for the workpiece as required so that the control device can adjust the individual parts and drives or electric motors, which are used to machine the workpiece, according to the machining data and can monitor their performance.

Consequently, in one preferred embodiment, the machining data recorded by the tool before the rechargeable battery is replaced are also stored in the storage device of the tool when the removal of the rechargeable battery from the tool is detected. That is to say, the machining data and machining parameters determined by the control device of the tool by monitoring the working heads and parts of the tool used to machine the workpiece, that is to say actual machining data and actual machining parameters, are preferably only stored in the storage device or the non-volatile memory of the tool when, for example, the control device detects the removal of the rechargeable battery or the planned removal of the rechargeable battery. However, it is also conceivable for the machining data transmitted from the central storage device to the tool and/or the machining data recorded by the tool to be stored in the storage device of the tool in a substantially continuous manner during use of the tool. Consequently, the desired machining data, that is to say the machining data transmitted from the central control device to the tool and preferably to the transmitting and receiving device of the tool, as well as the actual machining data and the actual machining parameters detected or determined by the control device or preferably the measuring device and the detection device during the machining of the workpiece by monitoring the working heads and parts used to machine the workpiece are substantially immediately stored in the storage device or in the non-volatile memory of the tool. This dispenses with buffering of the actual and/or desired machining data or the actual machining parameters in a volatile memory such as the main memory.

In one preferred embodiment, transmission of the machining data transmitted from the central storage device to the tool and the transmission of recorded machining data from the tool to the central control device are carried out using a wireless radio link. Consequently, not only the central control device transmits the desired machining data to the tool or to the transmitting and receiving device of the tool via a wireless radio link, for example Bluetooth, but the tool also transmits the determined actual machining parameters, in conjunction with the actual machining data, to the central control device using the transmitting and receiving device. The data transmitted by the tool are preferably stored in a storage device of the central control device and are supplied, for example, to a database system or to an analysis tool or analysis software which makes it possible to establish the actual machining parameters for a particular workpiece which was machined using a particular tool (that is to say the actual machining data). These actual machining data which are preferably stored for a long time make it possible for the worker or else another person to carry out a quality analysis for the tool or the machining process.

Further advantages, aims and properties of the present disclosure are explained using the following description of the enclosed drawing which illustrates, by way of example, one embodiment of the tool according to the disclosure and an electronic circuit of one embodiment of the tool according to the disclosure.

DETAILED DESCRIPTION

Figure 1:
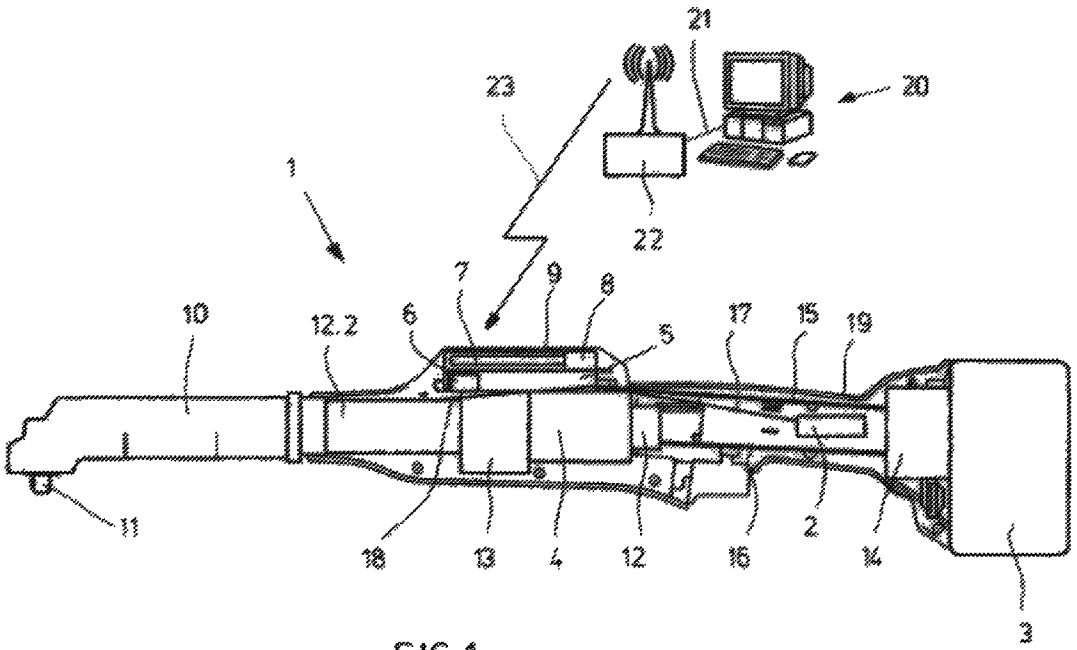
FIG. 1 shows a schematic sketch of one embodiment of the tool according to the disclosure.

The description below and the accompanying figures provide a general understanding of the environment for the apparatus and method disclosed herein as well as the details therefor. In the drawings, like reference numerals are used throughout to designate like elements.

FIG. 1 shows a schematic sketch of one embodiment of the tool 1 according to the disclosure which has an electrical element 2 for storing or buffering electrical energy or electrical current in order to supply a control device 5 with electrical energy at least for a short time during the operation of replacing the main rechargeable battery 3 or the rechargeable battery 3, which supplies or feeds an electric motor 4 with electrical energy, in order to avoid having to shut down an operating system running on the control device and consequently having to start up or reboot this operating system again after a new or charged rechargeable battery 3 has been inserted.

The control device 5 is part of a control and display unit 9 which additionally preferably has a display device 7, for example a screen 7, an input device 8, for example a keyboard 8, and a transmitting and receiving device 6, for example a radio module 6.

Program data or machining data can be input using the input device 8 and can be transmitted to the control device 5. The input of the data and the data which have been input are displayed to the worker or user via the display device 7. However, this display device 7 can also be used to display currently measured machining parameters, for example the rotational speed of the electric motor 4, which has a direct effect on the rotational speed of the working head 11 or machining part 11 which is in the angle head 10 and is driven by the electric motor 4.

In order to record such machining parameters, a first measuring device 12, for example an angle sensor 12, is arranged on the electric motor 4 or is connected to the latter, for example, in such a manner that the angle of rotation of the rotor and/or the angle of rotation the shaft of the electric motor 4, which is operated by the rotor, can preferably be detected or controlled using suitable sensors or the change in said angle relative to a stationary part can be determined or controlled.

A second measuring device 12.2, for example a measuring shaft 12.2 or measuring electronics 12.2, can preferably be used to measure or determine the torque of the shaft operated by the rotor of the electric motor 4, thus making it possible to infer a torque of the working head 11.

Interposed between the electric motor 4 and the second measuring device 12.2 is a transmission 13 which can be used to change the movements or the torque which acts on the shaft, such that the handheld screwdriver or the battery-operated handheld screwdriver illustrated in FIG. 1 can accordingly screw a screw into a workpiece and can also screw said screw out of the workpiece.

Drive electronics 14 which are arranged on the rechargeable battery 3 in order to be supplied with electrical energy from the latter control and regulate the drive of the electric motor 4 in order to move the working head 11 according to the running program or according to machining data and machining parameters stored in the control devices.

That is to say, if, for example, the control device 5 has been informed by the transmitted machining data that, in a machining step "one", an M16 screw, for example, is intended to be screwed into a corresponding threaded bore at a defined rotational speed, the control device 5 transmits these data to the drive electronics 14 which adjust the motor 4 and preferably also the transmission 13 in such a manner that this M16 screw can be screwed in at the predefined rotational speed.

Consequently, there is a preferably wired first line 15, preferably a two-part line, or lead 15 between the control device 5 and the drive electronics 14 or the rechargeable battery 3 in order to transmit, for example, corresponding data, signals and/or information from the control device 5 to the drive electronics 14 and, conversely, to provide the control device 5 with electrical energy from the rechargeable battery 3. Therefore, the first two-part line 15 has a data line for transmitting the data and/or the signals from the control device 5 to the drive electronics 14 and a power line for transmitting electrical energy from the rechargeable battery 3 to the control device 5.

As a result, there is also a preferably wired second line 16, preferably a two-part line, or lead 16 between the drive electronics 14 or the rechargeable battery 3 and the electric motor 4 or the angle sensor 12 in order to control or regulate the electric motor 4 according to the machining data present in the control device 5 and to supply the electric motor and the angle sensor 12 with electrical energy from the rechargeable battery 3.

A third preferably wired two-part line 17 or lead 17 exists between the control device 5 and the electrical element 2 which is preferably a capacitor 2 or a buffer capacitor 2. This makes it possible to drive the capacitor 2 when removing the rechargeable battery 3 in such a manner that it performs a charging operation, for which purpose the capacitor 2 must preferably be connected to the rechargeable battery 3 via an electrical line (not shown here).

Furthermore, the line 17 which preferably consists of a data line and a power line allows the flow of an electrical current from the capacitor 2 to the control device 5 when the rechargeable battery 3, which is preferably used to provide electrical energy, is replaced, with the result that the control device 5 does not need to be completely switched off but rather only changes to a standby mode, that is to say changes to a standby operating state, with the result that the operating system installed on the control device 5 does not need to be shut down.

A connection 18 or a data line 18, preferably for transmitting data and/or signals, likewise preferably exists between the second measuring device 12.2, that is to say the measuring shaft 12.2 or the measuring electronics 12.2, and the control device 5, with the result that it is possible to interchange data between the control device 5 and the second measuring device 12.2 in a substantially continuous manner. As a result, the second measuring device 12.2 can transmit the measurement data or actual machining parameters determined by it to the control device 5 in a substantially continuous manner, which control device compares said data or parameters with the desired machining parameters stored in the preferably integrated storage device (not shown here), preferably using an integrated comparison device (not shown here), in order to possibly adjust the movements of the working head by resetting the rotational speed, for example.

The individual devices, for example the control device 5, the display device 7, the input device 8, the radio device 6 or the radio module 6, the first measuring device 12 and the second measuring device 12.2, the drive electronics 14, the electric motor 4 and/or the transmission 13, are fed with electrical energy or current from the rechargeable battery 3 in order to perform their functions or carry out their work. For this purpose, the individual devices listed above are connected to the rechargeable battery 3 via electrical power lines (not shown here).

The entire controller and the controlled drives are surrounded by a housing 19 which protects them from contamination and destruction or damage.

The machining data and the corresponding machining parameters are preferably transmitted via a wireless radio link, for example Bluetooth or WLAN, from a central control device 20, for example a central computer 20, which is preferably connected to a radio access point 22 via a wired line 21, for example a LAN line.

The radio module 6 of the tool 1 establishes a radio link 23 to this radio access point 22 in order to receive, on the one hand, desired machining data from the central computer 20 and to store said data in the control device 5 and preferably in the storage device of the control device 5.

On the other hand, the radio module 6 can use this radio link 23 to transmit the determined actual machining data, which are preferably stored in the control device 5 and preferably in the storage device there at least for a short time, to the central computer 20.

As a result, the user can subsequently carry out a quality analysis on the central computer 20 with regard to the tool 1 or the workpiece (not shown here) machined by the tool 1.

Figure 2:
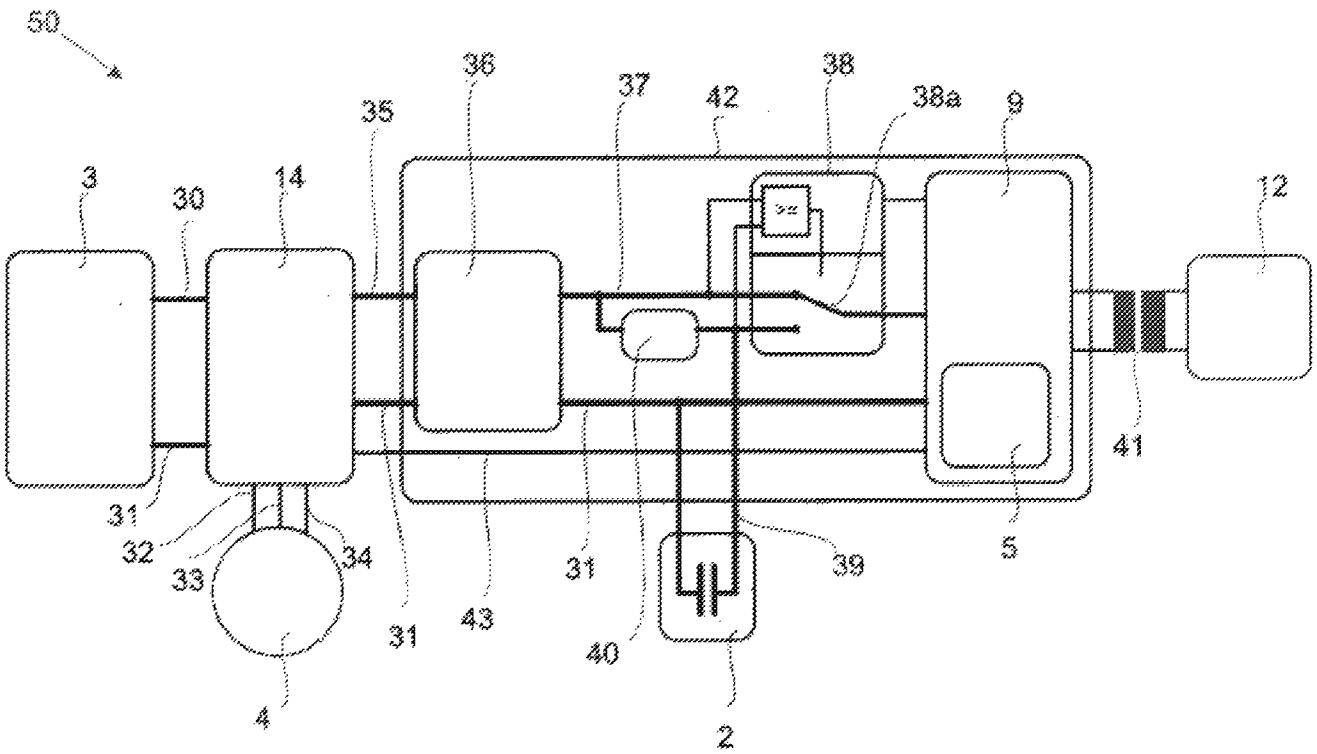
FIG. 2 shows a schematic sketch of a block diagram of one embodiment of the tool according to the disclosure.

FIG. 2 illustrates a schematic sketch of a block diagram 50 of one embodiment of the tool according to the disclosure. In this case, it is clearly seen that the rechargeable battery 3 is connected to the drive electronics 14 or a starting switch 14 via a positive connecting line 30 or positive power line 30 and a negative connecting line 31 or negative power line 31.

Consequently, power conduction or conduction of electrical energy is enabled, only for conducting electrical energy from the rechargeable battery 3 to the corresponding devices, when the starting switch 14 has been activated, that is to say the tool is switched on and the drive electronics 14 have consequently been started.

Consequently, the drive electronics 14 or the starting switch 14 is/are likewise connected to the electric motor 4 via corresponding electrical lines 32, 33, 34 in order to conduct the electrical energy required by the electric motor 4 from the rechargeable battery 3 to the electric motor 4 when the starting switch 14 is activated or to interrupt the conduction of electrical energy from the rechargeable battery 3 to the electric motor 4 when the starting switch 14 is deactivated.

A switched-mode power supply 36 which, for example, converts an unstabilized DC or AC input voltage into a DC voltage of a different defined level is connected to the drive electronics 14 or the starting switch 14 via a positive electrical line 35 (positive pole) or a positive supply line 35 in order to be supplied with electrical energy from the rechargeable battery 3 when the starting switch is activated.

After the input voltage received in the switched-mode power supply 36 has been converted, the electrical energy coming from the rechargeable battery 3 is forwarded, from this switched-mode power supply 36, to the control device 5 or the control and display unit 9, which comprises the control device, the display device, the input device and the transmitting and receiving device or the radio module, via a further electrical line 37 or a further electrical supply line 37 via a monitoring controller 38.

The monitoring controller 38 preferably has a switching unit 38*a* or an electrical switch 38*a* which can be used to change over between a rechargeable battery mode and a buffer mode. That is to say, when the rechargeable battery can no longer provide the control and display unit 9 and preferably the control device 5 with electrical energy on account of the rechargeable battery being replaced or on account of the rechargeable battery being emptied, the switching unit 38*a* of the monitoring controller 38 changes over, that is to say the switch is thrown, with the result that an electrical circuit is established with the buffer element 2 or the electrical element 2 or the buffer capacitor 2 or the capacitor 2.

This capacitor 2 is consequently connected, via a positive electrical line 39 or a positive supply line 39, to charging electronics 40 which are connected in parallel with the monitoring controller 38. These charging electronics 40 are preferably used to charge the capacitor 2 in a continuous manner during operation of the tool. However, it is also conceivable for the charging electronics 40 to be able to charge the capacitor 2 only when they receive a signal from the control device 5. This signal is output when, for example, replacement or planned replacement of the rechargeable battery is detected by the control device 5 or the control device 5 determines a very low battery level of the rechargeable battery 3, with the result that it can be assumed that the rechargeable battery must be replaced within a short time.

If the switching unit 38*a* is now thrown or changed over in such a manner that the electrical connection between the supply line 37 and the control and display unit 9 is interrupted and a new electrical connection is established between the capacitor 2 and the control and display unit 9, the monitoring controller 38 consequently changes over from a rechargeable battery mode to a buffer mode.

As a result, the control and display unit 9 is now only supplied with electrical energy from the capacitor 2 and it is possible to replace the rechargeable battery 3 without having to switch off the control and display unit 9 and preferably the control device 5 of the control and display unit 9.

The first measuring device 12 and/or the second measuring device 12.2 is/are connected to the control and display unit 9 and especially to the control device 5 of the control and display unit 9 by means of a transmission device 41 or a data transmission line 41 in order to receive data and/or signals from the control device 5 or else to transmit data and/or signals to the latter.

The control and display unit 9 or the control device 5 of the control and display unit 9 is connected to the drive electronics 14 or the starting switch 14 via another data transmission line 43 or a control line 43, with the result that the control device 5 finds out or receives the information relating to activation or deactivation of the starting switch 14 by means of data and/or signal transmission.

Furthermore, the control signals which originate from the drive electronics are transmitted via this data line 43 in order to control the drives of the tool according to the machining data. These signals corresponding to the machining data or the machining parameters are transmitted from the control device 5 of the control and display unit 9 to the drive electronics 14 via the data line 43.

The switched-mode power supply 36, the charging electronics 40, the monitoring controller 38 with the switching unit 38*a* and the control and display unit 9 or the control device 5 of the control and display unit 9 are parts of a supply/control/display unit 42.

The applicant reserves the right to claim all of the features disclosed in the application documents as being essential to the disclosure if they are novel over the prior art individually or in combination. It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A portable tool for machining a workpiece, the tool comprising:

a drive device configured to drive a working head;

a rechargeable battery configured to provide electrical energy to the drive device;

a storage device configured to store machining data;

a transmitting and receiving device configured to transmit and receive the machining data to and from a central control device;

an electrical element configured to provide electrical energy while the rechargeable battery is removed; and a control device having an operating system for controlling machining parameters of the tool, the control device being configured to:

detect a removal of the rechargeable battery from the tool;

operate a switch to connect the electrical element to the control device and disconnect the rechargeable battery from the control device in response to detecting the removal;

store the machining data in the storage device in response to detecting the removal; and change to a standby operating state after storing the machining data in the storage device, the storage device being unable to store new machining data in the standby operating state, the transmitting and receiving device being unable to transmit and receive the machining data in the standby operating state, a wireless link between the transmitting and receiving device and the central control device being maintained in the standby operating state.

2. The tool of claim 1, wherein the electrical element is a capacitor.

3. The tool of claim 1, wherein the tool is a battery-operated handheld screwdriver.

* * * * *